United States Patent [19]

Trousdell

[11] 4,280,795

[45] Jul. 28, 1981

[54] INTERBLADE SEAL FOR AXIAL FLOW ROTARY MACHINES

[75] Inventor: Edmund D. Trousdell, Tolland, Conn.

[73] Assignee; United Technologies Corporation, Hartford, Conn.

[21] Appl. No.: 107,296

[22] Filed: Dec. 26, 1979

[51] Int. Cl.[3] ..... F01D 5/32

[52] U.S. Cl. ..... 416/218; 416/193 A; 416/221

[58] Field of Search ..... 416/215-218, 416/221, 193 A

[56] References Cited

U.S. PATENT DOCUMENTS

| | | | |
|---|---|---|---|
| 2,846,184 | 8/1958 | Fournere | 416/221 |
| 3,383,094 | 5/1968 | Diggs | 416/215 |

*Primary Examiner*—William L. Freeh

*Attorney, Agent, or Firm*—Robert C. Walker

[57] ABSTRACT

An object of the invention is to prevent the leakage of working medium gases across a rotor stage beneath the platforms of the rotor blades.

A rotor assembly structure in which the concepts of the present invention are employable is disclosed. Techniques for blocking the leakage of working medium gases around a rotor stage beneath the platforms of the blades are discussed.

3 Claims, 5 Drawing Figures

INTERBLADE SEAL FOR AXIAL FLOW ROTARY MACHINES

DESCRIPTION

1. Technical Field

This invention relates to axial flow rotary machines, and more particularly to sealing between the blades of such a machine.

The concepts were developed in the gas turbine engine field, but have wider applicability to rotary machines in general.

2. Background Art

In gas turbine engines of the type in which the present concepts were developed, working medium gases are compressed within a compression section, burned with fuel in a combustion section, and expanded through one or more turbine sections. Within the compression and turbine sections the working medium gases are flowed along an annular flowpath through alternating stages of rotor blades and stator vanes. The flow of working medium gases within the flowpath is essentially axial in direction and such engines are, therefore, classified within the generic field of axial flow machines.

Internal pressures within the flowpaths of modern machines may approach four hundred pounds per square inch (400 psi) and the pressure differential across any single row of rotor blades is typically on the order of ten to fifty pounds per square inch (10–50 psi). The prevention of leakage of working medium gases around the blades is of principal concern in the design of engines.

Engines in widespread use today employ rotors in which the blades are loaded "axially" into a supporting disk. A root section of each blade extends downwardly into engagement with a correspondingly shaped slot in the disk. The leakage of working medium gases around the airfoil surfaces of the blades is prevented, for example, by affixing sideplates or coverplates to the disk over the root sections of the blades. Such constructions are representatively illustrated in U.S. Pat. Nos. 3,887,298 to Hess et al entitled "Apparatus for Sealing Turbine Blade Damper Cavities"; 3,936,222 Asplund et al entitled "Gas Turbine Construction"; and 3,957,393 to Bandurick entitled "Turbine Disk and Sideplate Construction", of common assignee herewith.

In another type of rotor system, the rotor blades are loaded "tangentially" into an attachment slot which extends circumferentially about the rotor rather than axially thereacross. Blades are loaded into the slot at one or more locations and displaced circumferentially around the slot as subsequent blades are added to the assembly. The anticipated leakage mode of working medium gases across such blades is radially inwardly between blades, axially rearwardly across the attachment slot and radially outwardly between blades. Representative constructions illustrating such a rotor assembly and techniques of blocking the flow of leakage medium are shown in U.S. Pat. No. 3,972,645 to Kasprow entitled "Platform Seal-Tangential Blade", and U.S. patent application Ser. No. 90189 filed Nov. 1, 1979, to Trousdell et al entitled "Self-Actuating Rotor Seal", also of common assignee herewith. Scientists and Engineers in the turbine engine field continue to search for new structures capable of blocking the leakage described.

DISCLOSURE OF INVENTION

According to the present invention a plurality of "T" shaped interblade members are spaced along and extend outwardly from a wire to form an interblade seal for a tangentially loaded rotor.

According to one embodiment of the invention the root sections of blades contained within a rotor assembly in which the interblade seal is installed, hold the wire at the base of the blade attachment slot such that a curtain formed by a first portion of each interblade member extends outwardly between the adjacent blades from the wire over the full radial depth of the slot.

A primary feature of the present invention is the interblade members. The members have a "T" shaped cross section geometry including a first portion for blocking the axial leakage of working medium gases between the root sections of adjacent blades and a second portion for blocking the radial leakage of working medium gases between the platform sections of adjacent blades. In one effective embodiment each interblade member is fabricated of sheet metal material and is mechanically crimped to the wire at the desired spacing from the adjacent members. The sheet metal material has sufficient flexibility so as to be deformable against the undersides of the blade platforms in operative response to rotational forces.

A principal advantage of the present invention is the enablement of effective sealing across the circumferentially extending slot of a tangentially loaded rotor. A curtain blocking the axial leakage of working medium gases is provided by the first portion of each interblade member. Each curtain is held accurately within the slot by the wire which also restrains the curtain under centrifugally generated loads. The wire is held at the bottom of the attachment slot by and beneath the root sections of the blades. Effective sealing contact between the second portion of each interblade member and the blade platform sections against which the portion rests is achieved by allowing the second portion to deform against the undersides of the platform.

The foregoing, and other features and advantages of the present invention, will become more apparent in the light of the following description and accompanying drawing.

Best Mode for Carrying Out the Invention

Figure 1:
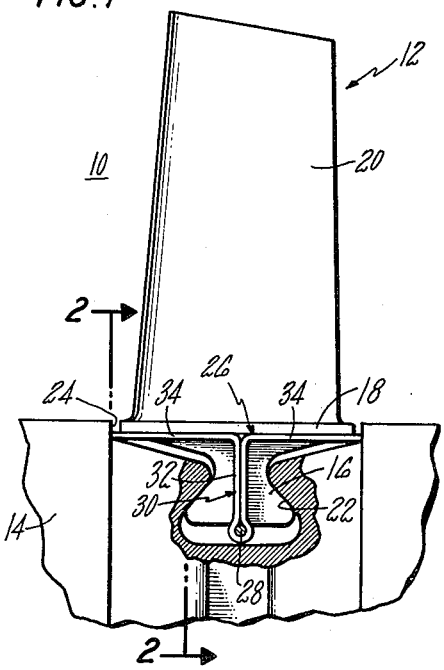
FIG. 1 is a cross section view of a portion of a rotor assembly incorporating the concepts of the present invention.

A cross section view taken through a portion of the rotor of a gas turbine engine is illustrated in FIG. 1. The engine is of the axial flow type in which an annular flowpath 10 for working medium gases extends axially therethrough. Rotor blades, such as the single blade 12 illustrated, extend radially across the flowpath from a supporting disk or drum 14. Each blade has a root section 16, a platform section 18 and an airfoil section 20. The disk has a circumferentially extending channel or slot 22 into which the root sections of the blades are insertable and retainable. Although not directly shown, the blades are insertable at one or more locations along the attachment slot and are slideable circumferentially around the slot as subsequent blades are loaded into the slot. Such rotors are referred to in the industry as "tangentially" or "circumferentially" loaded rotors.

The slot 22 into which the root sections of the blades are insertable may have any of a number of cross section geometries. As illustrated, the cross section geometry resembles the tail of a dove and is known widely in the industry as a "dovetail" slot. Coextensive with the attachment is a recessed region 24 at the periphery of the disk or drum 14. An interblade seal 26 for blocking the leakage of working medium gases axially between the root sections of adjacent blades and for blocking the recirculation of working medium gases between the platform sections of adjacent blades is provided.

Figure 2:
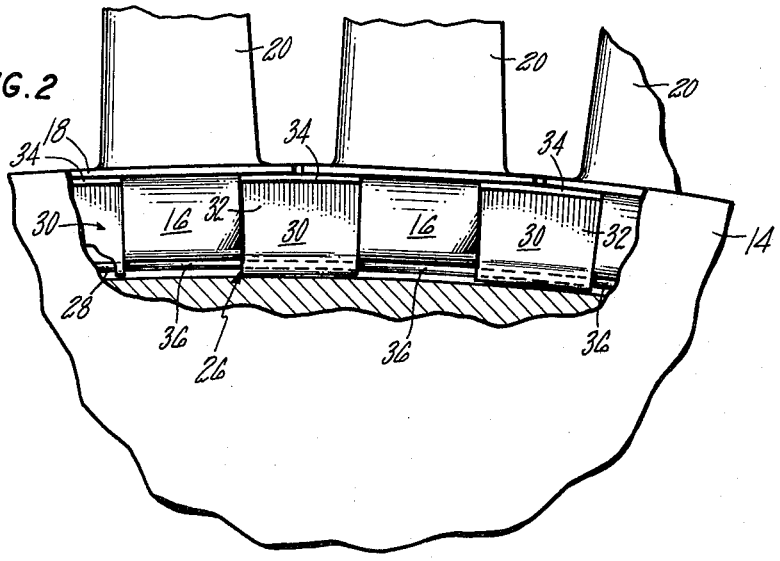
FIG. 2 is a sectional view taken along the line 2—2 as shown in FIG. 1.

The interblade seal 26 is formed of a circumferentially extending wire 28 and a plurality of interblade members or curtains 30 disposed one each between each pair of adjacent rotor blades 12. Each curtain is formed to a "T" shaped cross section and includes a first portion 32 extending upwardly from the wire and a second portion 34 extending laterally from the first portion. As illustrated, the second portion extends laterally within the recessed region 24 in both the upstream and downstream directions from the first portion. A plurality of the interblade members 30 are affixed to a single wire 28 such as by crimping, brazing, welding or other means. A plurality of the members disposed along a single wire are illustrated in FIG. 2. In an effective embodiment it is contemplated that two (2) continuous wires each of which extends over a one hundred eighty degree (180°) arc will be employed.

Each portion 36 of the wire 28 between adjacent interblade members 30 runs beneath the root section 16 of a corresponding blade. The interblade seal 26 is radially restrained in the slot 22 under centrifugally generated loads by the interaction of the blades over the wire. The restrained wire holds the first portion 32 of the member 30 at the bottom of the slot 22 for blocking the leakage of working medium gases axially between the root sections of adjacent blades. Additionally the second, and laterally extending portion 34 of each member 30 is coextensive with at least a portion of the platform sections 18 of the adjacent blades. Under centrifugally generated loads the second, and laterally extending portion is urged into abutting contact with the undersides of the platforms to prevent the recirculation of working medium gases between platform sections. The rotational forces on the inter-blade seal override the pressure forces from the flowpath for working medium gases.

The interblade members 30 are fabricated from a material having a capacity to elastically deform and to a thickness having sufficient flexibility to enable the second portions 34 of the members 30 to conform to irregular contours beneath the platform sections of the blades. In most compressor embodiments of the invention, stainless steel sheet metal material, such as AMS 5510 material, fabricated to a thickness on the order of ten thousandths of an inch (0.010 in.) will be effective. A thirty thousandths of an inch (0.030 in.) diameter wire of stainless steel material such as AMS 5689 material is employable.

Figure 3A:
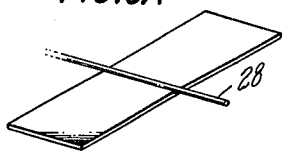
FIGS. 3A–3C are partial perspective views showing sequential steps in the manufacture of an interblade seal of the present invention.
Figure 3B:
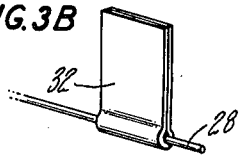
Figure 3C:
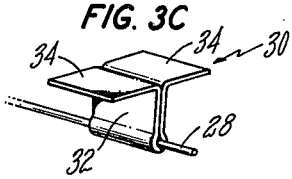

The interblade seal geometry described provides not only effective sealing, but economical manufacture as well. One sequence of manufacture is illustrated in FIGS. 3A–3C. Each member 30 of pre-contoured sheet material is placed beneath the wire 28 and folding in an upright manner to the FIG. 3B illustrated position. The member may be crimped to the wire at the desired location and spacing. Subsequently, the laterally extending second portions 34 are formed as illustrated in FIG. 3C. The first portions 32 extend upwardly from the wire in a plane containing the wire. The second portions extend from the first portions in a plane essentially perpendicular to the plane of the first portions. However, the second portions in any particular embodiment may deviate somewhat therefrom to accommodate the platform section geometry.

Although the invention has been shown and described with respect to detailed embodiments thereof, it should be understood by those skilled in the art that various changes and omissions in form and detail may be made therein without departing from the spirit and the scope of the invention.

I claim:

1. A blade root seal of the type utilized with a tangentially loaded rotor having a circumferentially extending retaining slot for rotor blades, the seal comprising:

a wire adapted to be disposed at the bottom of the retaining slot; and a plurality of interblade members attached to said wire and spaced therealong, one each for disposition between each pair of adjacent blades on the rotor wherein each interblade member is formed to a "T" shaped cross section including a first portion extending upwardly from the wire in a plane containing the wire and a second portion extending laterally from the first portion in a plane essentially perpendicular to the first portion.

2. The blade root seal according to claim 1 wherein each of said interblade members is formed of sheet metal material which is crimped to the wire to effect the desired spacing along the wire and which extends upwardly to form the first portion and thence laterally from the first portion to form the second portion.

3. A rotor assembly for an axial flow rotary machine, comprising:

a rotor disk having a rotor blade attachment slot extending circumferentially about the periphery thereof;

a plurality of rotor blades spaced circumferentially about the disk and extending outwardly therefrom, each blade having a root section engaging the attachment slot and a platform section extending over the slot; and an interblade seal disposed in said slot and including a circumferentially extending wire adapted to be disposed at the bottom of the attachment slot between the root sections of the rotor blades and the rotor disk, and a plurality of interblade members attached to the wire, one such member disposed between the root sections of each pair of adjacent rotor blades wherein each interblade member is formed to a "T" shaped cross section including a first portion extending outwardly from the wire between the root sections of the adjacent blades and a second portion extending laterally beneath the platform sections of adjacent blades from the first portion.

* * * * *